US007624482B2

(12) United States Patent
Kusayama et al.

(10) Patent No.: US 7,624,482 B2
(45) Date of Patent: Dec. 1, 2009

(54) ARTICLE WITH SLIDE FASTENER

(75) Inventors: Masahiro Kusayama, Toyama-ken (JP); Yutaka Tominaga, Toyama-ken (JP); Ryo Tanaka, Toyama-ken (JP)

(73) Assignee: YKK Corporation, Tokyo (JP)

( * ) Notice: Subject to any disclaimer, the term of this patent is extended or adjusted under 35 U.S.C. 154(b) by 417 days.

(21) Appl. No.: 11/732,870

(22) Filed: Apr. 5, 2007

(65) Prior Publication Data

US 2007/0251063 A1 Nov. 1, 2007

(30) Foreign Application Priority Data

May 1, 2006 (JP) ..... 2006-127692

(51) Int. Cl.
*A44B 19/32* (2006.01)
*A44B 19/36* (2006.01)

(52) U.S. Cl. ..... 24/432; 24/434

(58) Field of Classification Search ..... 24/434, 24/433, 432, 435, 436, 405, 387, 381
See application file for complete search history.

(56) References Cited

U.S. PATENT DOCUMENTS 1,964,485 A * 6/1934 Seaver ..... 24/435
2,571,072 A * 10/1951 Soave ..... 24/435
3,962,729 A * 6/1976 Cook ..... 2/234
4,353,760 A * 10/1982 Moertel ..... 24/381
6,223,349 B1 * 5/2001 Roiser ..... 24/381

* cited by examiner

*Primary Examiner*—Robert J Sandy
(74) *Attorney, Agent, or Firm*—Alston & Bird LLP

(57) ABSTRACT

An article with a slide fastener in which when a tearing force is applied to an article provided with a slide fastener and a slider makes contact with an end stop, a connecting member having flexibility and connecting between rear faces of right and left fastener stringers is disposed at a position on a side of a fastener element near the end stop, at which the force is not transmitted directly to the slider, a covering tape for covering at least the end stop and the connecting member is disposed on a rear face of the article, so that fastener elements and end stop are blocked from being damaged or the fastener elements are prevented from being dropped out of a fastener tape by a tearing force, and the connecting member is prevented from being hooked or caught by the slider so as to always realize a smooth slider operation.

10 Claims, 10 Drawing Sheets

ARTICLE WITH SLIDE FASTENER

BACKGROUND OF THE INVENTION

1. Field of the Invention

The present invention relates to various articles with slide fasteners, each of which is provided with a slide fastener and has a structure for preventing its fastener elements and end stop from being damaged and its slider from being loosed out of a fastener tape even when a strong tearing force is applied to the slide fastener.

2. Description of the Related Art

Slide fasteners have been adopted in a broad range of fields including clothes, miscellaneous articles, industrial material, various seats for automobile, train, airplane and the like, and tunnels. In general, it is used as opening/closing device for clothes, miscellaneous products, bags and the like. As for an ordinary structure of a slide fastener, a slider is loaded on engaging element rows of a pair of right and left fastener stringers, on which a plurality of engaging elements are attached at equal pitches along opposing side edges, and an end stop is attached to both upper and lower ends of the engaging element row. An ordinary top end stop is attached to right and left fastener tapes except a special top end stop, and a bottom end stop is attached across opposing edge portions of the right and left fastener tapes. By sliding the slider along each element row, the engaging elements are engaged and disengaged.

The slide fastener is largely classified to two types. According to one type, engaging elements are attached to an identical plane to a fastener tape and its engaging element row is inserted through a guide passage of a slider comprising upper and lower blades and an element diamond. According to the other type called concealed type slide fastener, opposing side edges of a pair of right and left fastener tapes are bent into a U-like shape and set, engaging elements are attached along the right and left bent edges such that their heads oppose each other, and a slider having a lower blade and an element diamond is loaded on the element row, the element row being inserted therethrough.

Further if classified functionally, there are an ordinary slide fastener in which engaging elements made of metal or synthetic resin are attached to a fastener tape made of fiber and a slide fastener having a waterproof function. As for the typical structure of this waterproof slide fastener, a fastener tape has a waterproof structure in which both the front and rear faces of a core material are covered with an elastomer such as natural rubber or synthetic rubber, the core material being of woven or knitted fabric tape. Fastener elements made of synthetic resin are molded integrally along one side edge of the fastener tape so as to stride over both the front and rear faces by injection molding. Usually, a through hole is formed in an element attaching edge portion of the fastener tape at a position where each fastener element is molded. The through hole serves as a passage for molded resin of each fastener element and is provided to connect upper and lower half portions of a fastener element molded on the front and rear faces of the fastener tape.

Such a slide fastener may be attached to a variety of articles for use. However, if the slide fastener is attached to the back portion of, for example, a women's clothes which makes a slider operation difficult to perform or the operation of the slider is heavier than it in ordinary sliders in case of a wet suit which has a waterproof structure, the slide fastener of the article often needs to be opened or closed in an unreasonable posture depending on the types of the articles. Further, the aforementioned clothes is often fit to the body firmly even when the slide fastener is opened, so that it is extremely difficult to put it off. Thus, an opened portion of the clothes needs to be pulled strongly in order to expand the clothes further. When a strong force is applied to the article, the force is applied directly to the slider. As a result, the fastener elements running inside the slider may be damaged or the slider itself may be damaged or a pressing force applied to the bottom end stop of the slider is added. Consequently, the bottom end stop may be damaged or may loosed out of the attaching portion.

To meet such a circumstance, for example, U.S. Pat. No. 1,964,485 discloses a slide fastener, in which a tension tape having flexibility is disposed crosswise to fastener stringers between outer side edges of a pair of right and left fastener tapes at a position adjacent and above a bottom end stop attachment position on the rear face of the slide fastener, and its both end portions are sewed to the outer side edges of the fastener tapes and opposing side edges of clothes. In the slide fastener of U.S. Pat. No. 1,964,485, one of the opposing side edges of the clothes is provided with a covering portion extending so as to cover a pull tag of the slider and a mating side edge. By adopting such a configuration, even if a strong force (tearing force) is applied to right and left fastener stringers when attempt is made to open the right and left fastener tapes with the slider keeping contact with the bottom end stop, the tearing force is received by the tension tape, so that the force is blocked from being transmitted directly to the slider. As a consequence, the slider, the bottom end stop and the fastener elements are prevented from being damaged or coming off.

In the slide fastener disclosed in U.S. Pat. No. 1,964,485, only both the end portions of the tension tape are fixed to the outer side edges of the pair of right and left fastener tapes. The length of the tension tape is set to be slightly slack when the slide fastener is closed. As a result, if the slider is slid in an attempt to close the slide fastener, the lower blade of the slider is hooked by the tension tape or the tension tape is caught between the upper and lower blades of the slider when the slider passes through a space between the tension tape and the fastener stringer, thereby often disabling a subsequent slider operation. Consequently, the slide fastener cannot be closed completely, or if the slider is loosened from the tension tape by force, the tension tape may be damaged. In the worst case, the tension tape may be loose from its fixing state or the tension tape may be torn.

SUMMARY OF THE INVENTION

The present invention has been accomplished to solve these conventional problems, and an object of the invention is to provide an article with a slide fastener in which even when a strong tearing force is applied to a fastener tape in wet suits, clothes, bags or the like, the force is not applied directly to a slider, so that engagement elements and bottom end stop are not damaged or the engagement elements are not dropped out of the fastener tape and the tension tape is not hooked or caught by the slider, thereby always enabling a smooth slider operation.

To achieve the above-described object, according to an aspect of the present invention, there is provided an article with a slide fastener in which an end stop is attached striding over side edges of a pair of fastener tapes adjacent to an end portion of at least one element row of a pair of right and left fastener stringers each having an element row composed of a plurality of fastener elements provided in line along opposing element attaching edge portions of the pair of fastener tapes, the slide fastener being opened and closed by sliding a slider along the element row, being characterized by comprising a connecting member having flexibility which is disposed at a position adjacent to the end stop, at which no tearing force of the article is transmitted directly to the slider when the slider makes contact with the end stop, and the connecting member connecting rear faces of the right and left fastener stringers; and at least one covering tape which is disposed in an area on a rear face of the article, covering at least the end stop and the connecting member at the same time.

Preferably, the slide fastener comprises connecting member capturing means for always capturing the connecting member toward a side of the covering tape.

The end stop mentioned here includes a waterproof end stop which is applied to a waterproof slide fastener of, for example, a bag equipped with two sliders provided such that their rear mouths oppose each other, and whose sealing portions invade into element passage from the shoulder mouth side of each slider in a firm contact state so as to block water from coming in from outside.

Preferably, an typical aspect of the connecting member capturing means is a pressing tape piece disposed crosswise to the covering tape so as to stride over the connecting member on a side opposite to the covering tape with at least its both ends fixed to a rear face of the covering tape. However, the connecting member capturing means does not need to be the pressing tape piece, but includes a case where a central portion of the connecting member for connecting between the right and left fastener stringers is fixed directly to the rear face of the covering tape by sewing, welding and bonding with an adhesive agent.

The slider may be an ordinary slider comprising an upper blade, a lower blade, an element diamond disposed between the upper and lower blades, and a pull tag attached to a top face of the upper blade. Alternatively, the slider may be a slider for a concealed type slide fastener, comprising a lower blade, an element diamond erected from the lower blade, and a pull tag attached to a front end of the element diamond.

Although the fastener tape may be composed of a woven tape or knitted tape made of an ordinary fiber or a tape made of synthetic resin, it may be composed of a waterproof fastener tape having a waterproof layer made of elastomer or the like on both the faces of a pair of tape shaped core materials obtained by weaving or knitting.

The connecting member may be fixed linearly perpendicular to the longitudinal direction of the slide fastener such that its both end portions stride over right and left fastener stringers. Desirably, the connecting member may be folded back into a U-like shape with both the ends directed in a same direction, and both ends on one side of the connecting member are attached to rear faces of the fastener tapes such that a folded back portion faces a rear face of the covering tape. The both ends of the connecting member are fixed to the fastener tape portions of right and left fastener stringers by sewing, ultrasonic welding, welding with heat, or boding with an adhesive agent.

Desirably, the connecting member and the pressing tape piece are fixed to each other through their central portions. Further, at least one side edge of the covering tape is preferred to be fixed to the article along its entire length, and the other side edge may be fixed up to near the position where the connecting member is fixed. Typical examples of such an article include a wet suit, bags, and women's clothes.

According to the present invention, the connecting member for connecting the rear faces of right and left fastener stringers is disposed above the bottom end stop. Consequently, even if a strong tearing force is applied to the article when the slider comes into contact with the bottom end stop, the force is received by the connecting member. Thus, the force is not transmitted directly to the slider. For this reason, no special force is applied to a tape portion existing in a tape guide gap formed between upper and lower blades of the slider, so that the fastener tape is not damaged or any engagement element existing in an element guide space of the slider is never dropped out of the fastener tape. Further, when the strong tearing force is applied to the slider, the slider makes a firm contact with the bottom end stop with a strong force. As a consequence, the end stop may come off from the fastener tape or even if it does not come off, its attachment posture may be changed. Because according to the present invention, no large force is applied to the slider as described above, the end stop may not be damaged.

In the present invention, in addition to the above-described configuration, the covering tape is attached to at least an area between a position adjacent and above a slider position and the fixing position of the bottom end stop on the rear face of the article when the slider comes into contact with the end stop, and the connecting member capturing means for capturing the connecting member toward the side of the covering tape is provided on the rear face of the covering tape. Consequently, a slider passage space is always secured between the connecting member and the rear face of the slide fastener, thereby eliminating interference of the slider with the connecting member.

In the pressing tape piece as a preferable example of the connecting member capturing means, at least both ends thereof are fixed to the covering tape crosswise to the connecting member striding over an opposite side of the connecting member to the covering tape. Consequently, the pressing tape piece always pulls the connecting member to the side of the covering tape, so that an interference between the slider and the connecting member is eliminated, thereby achieving a smooth sliding operation of the slider.

The connecting member may be fixed perpendicularly to the longitudinal direction of the slide fastener such that both ends portions thereof stride over right and left fastener stringers. In this case, the connecting member needs to be of a length necessary for providing the amount of motion when a strong force is applied to an article with an excess. Depending on the kind of the article, inconvenience in terms of appearance may occur and further, the connecting member may be caught between the slider and the engaging elements. To avoid this phenomenon, according to a preferred embodiment of the present invention, the connecting member is set so as to be folded back into a U-like shape, and with this state, its both ends are attached to the rear face of the fastener stringer. As a consequence, when no extreme tearing force is applied to the article, the folded state is maintained, thereby producing no inconvenience in terms of appearance. Moreover, when an extreme tearing force is applied to the article, the folded portion is stretched to block the right and left fastener stringers from being opened further. Consequently, the fastener tape and bottom end stop are protected from being damaged as described above.

To fix both the ends of the connecting member to the tape portion of the fastener stringer, various ways such as sewing, ultrasonic welding, welding with heat, and bonding with an adhesive agent are available, and these methods may be adopted appropriately based on the application field. If the article has a waterproof function, preferably, it is welded or bonded with an adhesive agent, and in case of ordinary clothes, it is fixed by sewing. The pressing tape piece is also fixed to the rear face of the covering tape through its both ends by the same means. Further, one side edge of the covering tape is fixed to the article throughout the entire length, and the other side edge may be fixed to the article up to near the fixing position of the connecting member. As a result, the end stop and an area from the end stop to the fixing position of the connecting member are always covered with the covering tape, so that they are not exposed outside.

In the case of clothes whose back portion is to be opened like a wet suit or women's one-piece dress, a user opens or closes the slide fastener by winding his or her arm around to the back. Particularly, the hip portion is larger than the waist portion. For this reason, when the user attempts to put it off, he or she pulls down the slider until it makes contact with the bottom end stop and needs to put it off by force. Because the clothes main body is attempted to be expanded largely at this time, a force at that time is transmitted strongly via the slider in a normal condition, so that an unreasonable force is applied to the fastener elements and bottom end stop within the slider. As a result, the fastener elements or bottom end stop may be deflected from their attachment positions of the fastener tape, and in the worst case, they may be damaged. At this time, the fastener tape may be also damaged deservingly.

When opening or closing, for example, bags, the slider is often operated violently as compared with clothes. Particularly, in the case of a travel bag in which various items are accommodated over its accommodation capacity, a large force of lateral direction attempting to open the fastener tape, that is, a large tearing force is applied to the slide fastener when the slide fastener is opened or closed. Thus, when opening or closing the bag, the slider needs to be operated strongly. For this reason, a strong force is applied to the slider when the slider is operated like the above-described clothes, a repulsive force of the accommodated items is added so that the tearing force is intensified, and the force at that time is transmitted via the slider. As a result, an unreasonable force is applied to the fastener elements and bottom end stop within the slider, thereby deflecting the attachment positions of the fastener elements or the bottom end stop or damaging the fastener tape.

Then, by connecting between the right and left fastener stringers with the connecting member as proposed in U.S. Pat. No. 1,964,485, the aforementioned inconvenience is eliminated. However, just if a flexible connecting member is attached, the connecting member is easily hooked by the lower blade or caught in a gap between the upper and lower blades in the case where the lower blade of the slider attempts to pass a space between the connecting member and the rear face of the fastener stringer when the slider is operated.

According to the present invention, in addition to these configurations, the covering tape is attached to the rear face of the article as described above, and the pressing tape piece is fixed to the rear face of the covering tape through its both ends striding over the connecting member. Consequently, also when the slider is operated, interference of the slider with the connecting member is eliminated, thereby enabling the sliding operation of the slider to be carried out smoothly. Therefore, such a configuration is preferably applicable to the aforementioned wet suit, women's clothes, bags or the like. The effects which the present invention exerts are considerably great.

DESCRIPTION OF THE PREFERRED EMBODIMENTS

Hereinafter, preferred embodiments of the present invention will be described in detail with reference to the accompanying drawings.

First Embodiment

Figure 1:
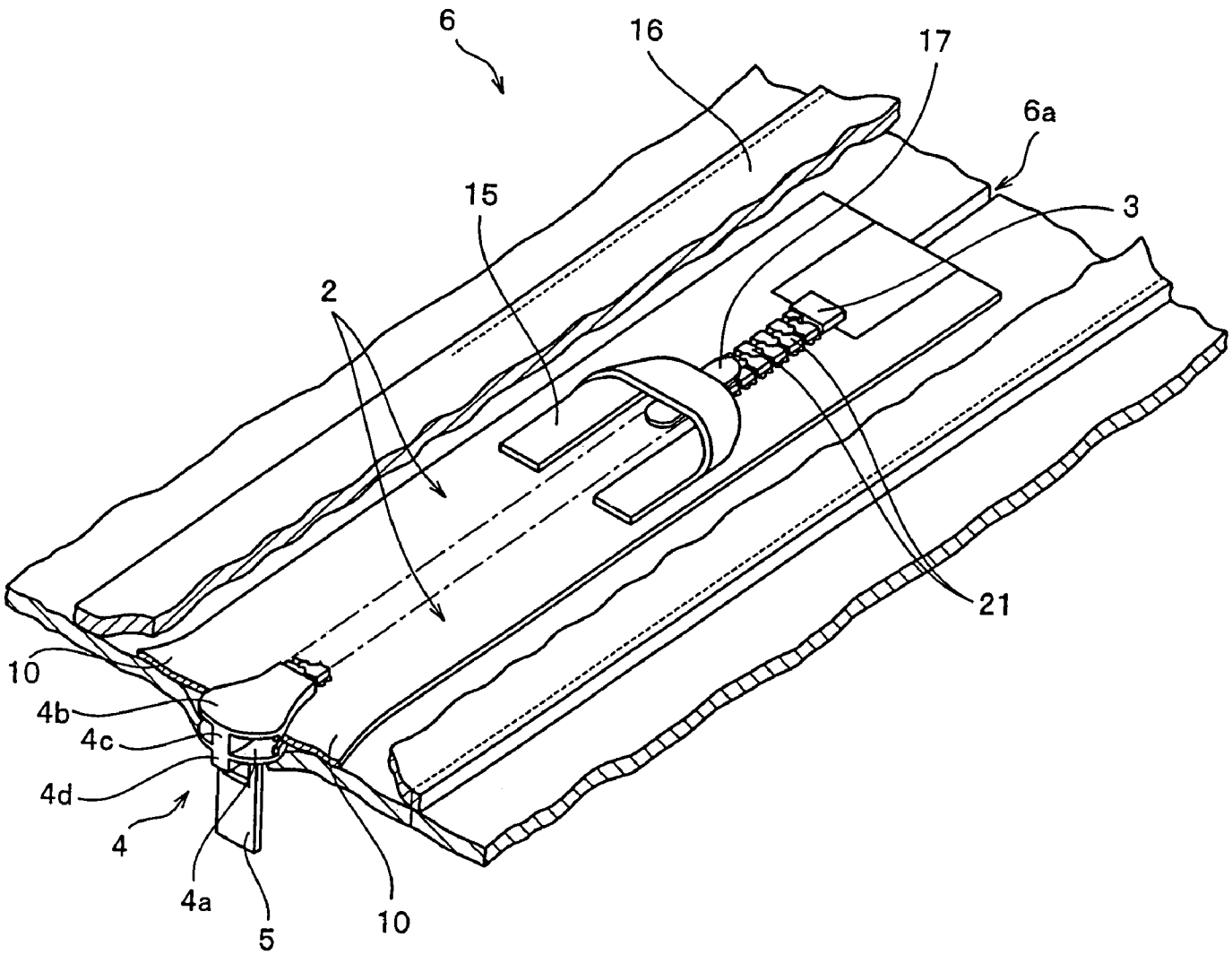
FIG. 1 is a partial perspective view of a bottom end area of a slide fastener attaching portion of a wet suit according to a first embodiment of the present invention as seen from its rear face.
Figure 2:
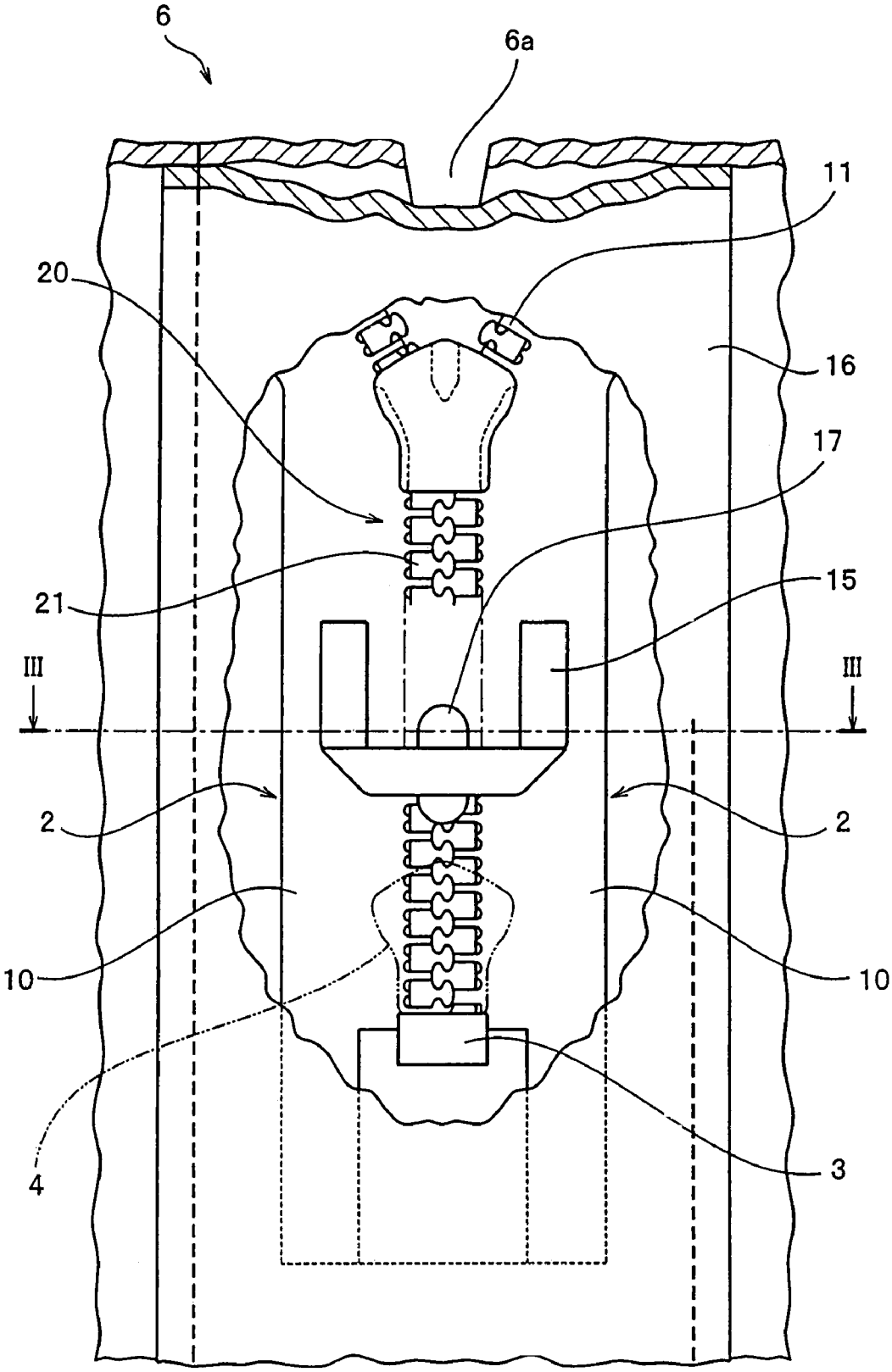
FIG. 2 is a partial rear view of a covering tape at the same portion with its part cut out.
Figure 3:
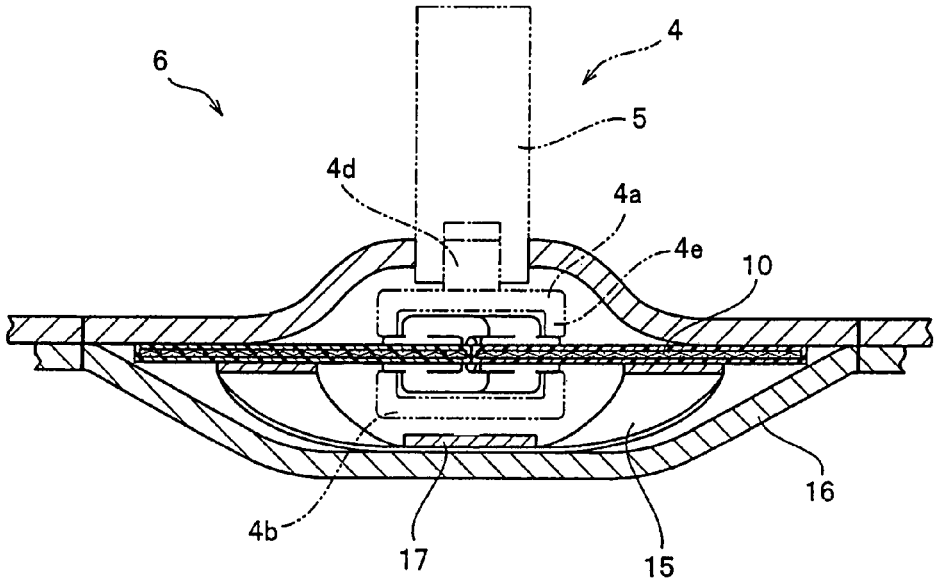
FIG. 3 is a sectional view taken along the line III-III in FIG. 2.
Figure 4:
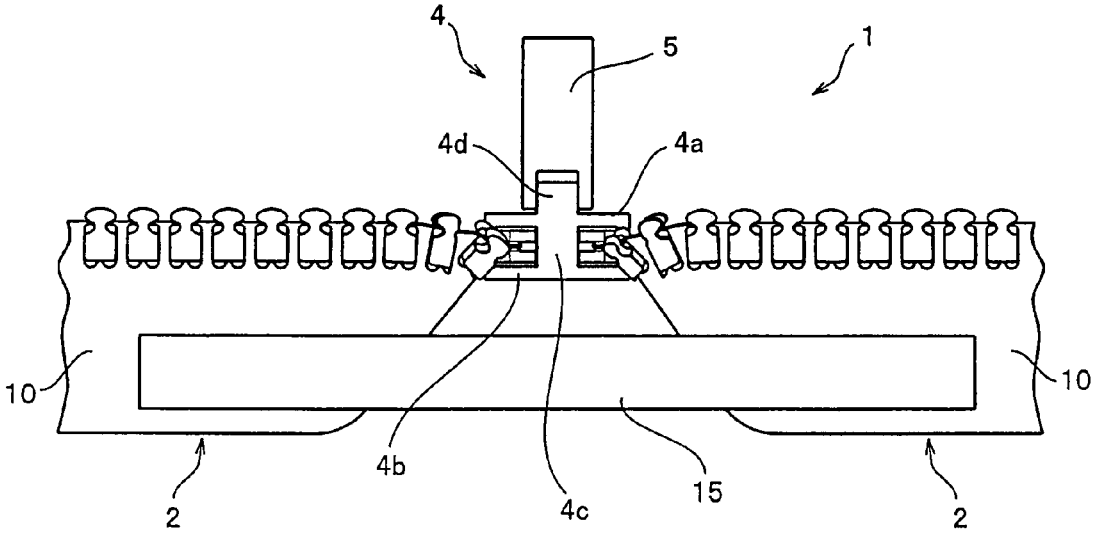
FIG. 4 is a front view of the fastener when a strong tearing force is applied to the slide fastener.

FIGS. 1 to 4 show a first embodiment of the present invention. FIG. 1 is a partial perspective view of a slide fastener attaching portion of a wet suit according to the embodiment with its part cut out. FIG. 2 is a partial plan view showing the internal configuration of the attaching portion with the central portion of a covering tape disposed in the attaching portion cut out. FIG. 3 is a sectional view taken along the line III-III in FIG. 2. FIG. 4 is a front view of the slide fastener as seen from the shoulder mouth side of the slider showing a state in which the rear face of the suit is pulled with a strong force so that a tearing force is applied. The tearing force mentioned here is a force of pulling the fastener stringers 2 in directions in which they depart from each other.

The wet suit 6, which is an article of this embodiment, is cut in the back portion of its upper half portion from the neck portion up to the waist portion such that its two sections are separated, and a waterproof slide fastener 1 is attached along the cut-in portion. In the slide fastener 1, an engagement gap to mating fastener elements 21 is produced along element attaching edge portions 11 which are opposing edge portions of a pair of waterproof fastener tapes 10, so that a plurality of fastener elements 21 are molded integrally on each side so as to form right and left fastener element rows 20. In the slide fastener 1, a top end stop (not shown) is respectively attached near the end portion of the fastener element 21 on the side of the neck portion of each fastener element row 20 formed on opposing a pair of fastener stringers 2. In addition, a single bottom end stop 3 is attached to the end portion on the side of the waist portion near the fastener elements 21 in an engaged state. The top end stop has a function which blocks the slider 4 from being loosed out at the end portion when the slide fastener 1 is closed, and the bottom end stop 3 has a function which blocks the slider 4 from being loosed out at the end portion when the slide fastener 1 is opened. A slider 4 made of synthetic resin or metal having an ordinary function is loaded on the fastener element row 20 between the top end stop and the lower end stop 3, the fastener element row 20 being inserted therethrough.

The waterproof slide fastener 1 applied to this embodiment is an ordinary waterproof slide fastener, and the slider used in the fastener has an ordinary structure. That is, as shown in FIGS. 1 and 4, the slider 4 for use in the embodiment comprises an upper blade 4*a*, a lower blade 4*b*, an element diamond 4*c* for connecting the shoulder mouth side half portions of the upper and lower blades 4*a*, 4*b*, a pull tag supporting ring 4*d* erected in the center of the top face of the upper blade 4*a*, and a pull tag 5. The upper and lower blades 4*a*, 4*b* have flanges 4*e* projecting in directions in which they approach each other on their right and left side lines. The fastener element 21 is guided in an element guide space produced by the upper and lower blades 4*a*, 4*b*, the flanges 4*e* and the element diamond 4*c*.

Figure 6:
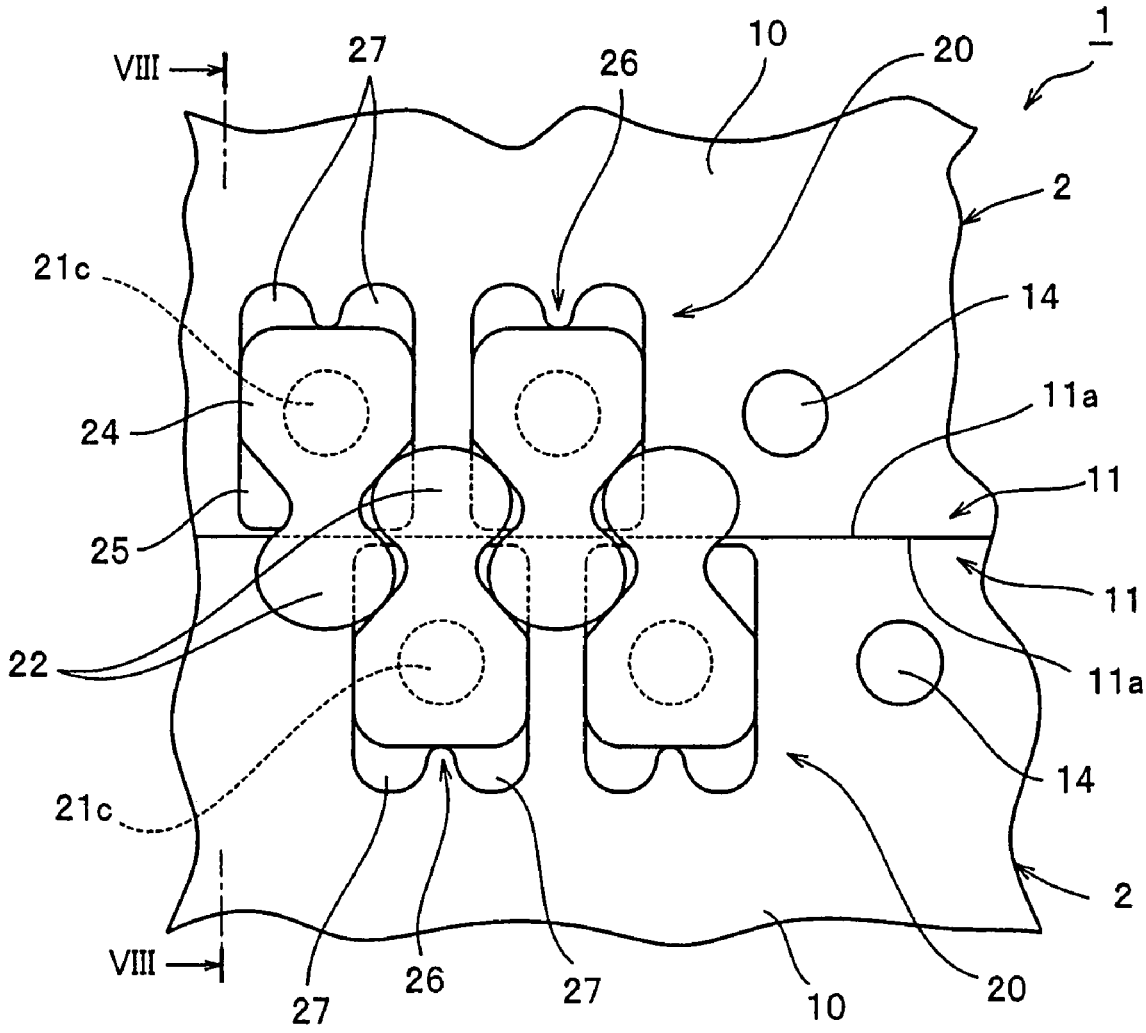
FIG. 6 is a plan view of major portions mainly showing an element attaching edge portion of a waterproof slide fastener for use in the first embodiment.
Figure 8:
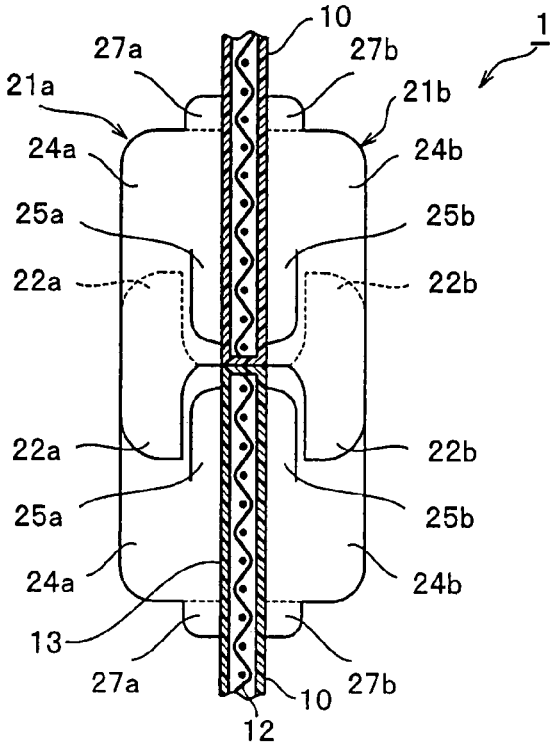
FIG. 8 is a sectional view taken along the line VIII-VIII in FIG. 6.

As shown in FIGS. 6 and 8, the waterproof fastener tape 10 is manufactured by covering the entire surface of a tape shaped core material 12 made of a fiber woven fabric or knitted fabric with an elastomer material 13 composed of a natural or synthetic rubber material or a variety of synthetic resins like a conventional fastener tape. Each element molding portion on the element attaching edge portion 11 of the fastener tape 10 has a through hole 14 large enough for molten material resin of the fastener elements 21 to pass therethrough.

On the other hand, the fastener element 21 comprises a coupling head 22 providing an oval shape slightly elongated in a vertical direction (in the longitudinal direction of the fastener) as seen in a plan view, a body portion 24 providing a substantially hexagonal shape as seen in a plan view, continuous from the coupling head 22 via a neck portion 23, wing-like shoulder portions 25 extending to the right and left sides between the neck portion 23 and the body portion 24, and leg portions 27 extending downward from the bottom end of the body portion 24 such that they are branched via a crotch portion 26. The fastener element 21 having such a configuration is constituted of half portions 21*a*, 21*b* which are connected integrally through a connecting portion 21*c* molded in the through hole 14 such that it sandwiches the element attaching edge portion 11 of the fastener tape 10, the half portions being molded on the front and rear faces of the fastener tape 10. In the meantime, the shoulder portion 25 may be omitted.

Respective half portions 22*a*, 22*b*; 23*a*, 23*b*; 24*a*, 24*b*; 25*a*, 25*b*; and 27*a*, 27*b* of the coupling head 22, the neck portion 23, the body portion 24, the shoulder portion 25 and the leg portion 27 are molded integrally in symmetrical shape sandwiching the fastener tape 10 on the front and rear sides of the fastener tape 10. The respective half portions 23*a*, 23*b*; 24*a*, 24*b*; 25*a*, 25*b*; and 27*a*, 27*b* excluding the coupling head 22 are integrated by welding on both the front and rear faces of the fastener tape 10.

Figure 7:
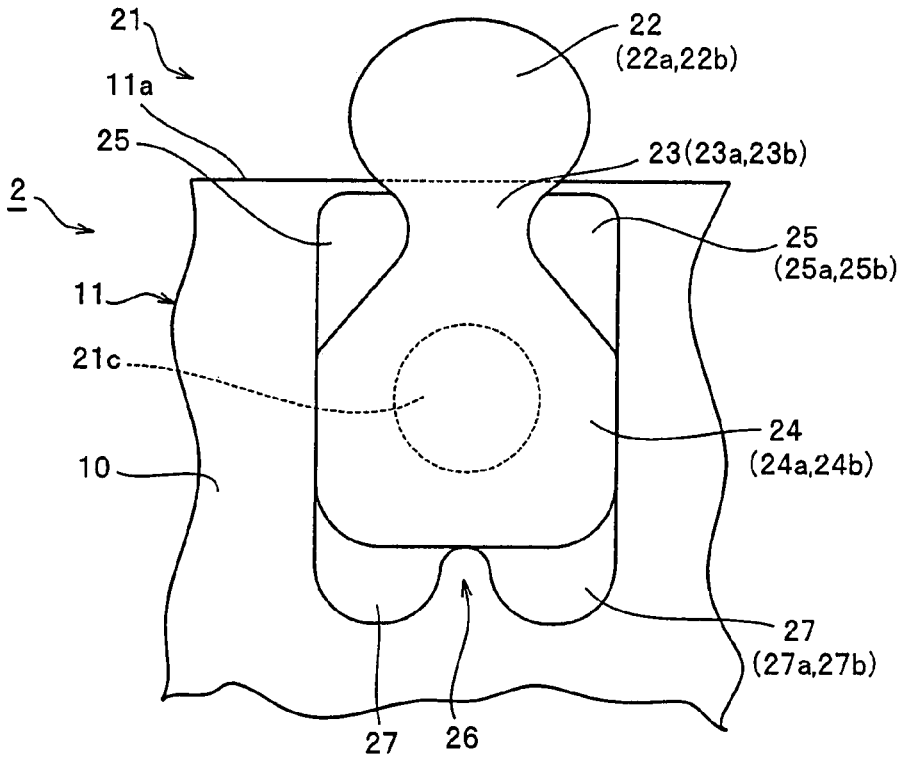
FIG. 7 is a partially enlarged plan view showing the configuration of the periphery of a single element in a fastener stringer of the same slide fastener.

The half portions 22*a*, 22*b* of the coupling head 22 molded symmetrically on the front and rear sides and sandwiching the fastener tape 10 are provided such that they extend to right and left outward from an edge 11*a* with a gap corresponding to the thickness of about one sheet of fastener tape 10 secured therebetween in a state in which the edge 11*a* of the element attaching edge portion 11 of the fastener tape 10 is exposed slightly outward as shown in FIG. 7. The exposed length of the edge 11*a* of the element attaching edge portion 11 of the fastener tape 10 is set to a dimension which allows an exposed end face of the edge 11*a* to make firm contact with the exposed end face of a mating fastener tape 10 when the coupling head 22 engages a mating one.

The thickness of each half portion 23*a*, 23*b*; 24*a*, 24*b* of the neck portion 23 and the body portion 24 is the largest, and the thickness of each half portion 25*a*, 25*b*; 27*a*, 27*b* of the shoulder portion 25 and the leg portion 27 is smaller than the thickness of the each half portion 23*a*, 23*b*; 24*a*, 24*b* of the neck portion 23 and the body portion 24 as shown in FIGS. 7 and 8. The outside surface of the half portion 22*a*, 22*b* of the coupling head 22 is on an identical plane to the outside surface of each half portion 23*a*, 23*b*; 24*a*, 24*b* of the neck portion 23 and the leg portion 24 as shown in FIG. 8. With such a configuration, when the fastener elements 21 engage each other, the half portions 25*a*, 25*b* of each shoulder portion 25 of the fastener elements 21 adjacent to the right and left sides make contact with the inner faces of the half portions 22*a*, 22*b* of the coupling head 22 of one fastener element 21, as shown in FIGS. 6 and 8.

In this embodiment, the waterproof slide fastener 1 having the above-described configuration is attached to the wet suit 6 as shown in FIGS. 1 to 3. That is, with the upper blade 4*a* on the side of the pull tag 5 of the slider 4 directed to the front surface side of the wet suit 6, the right and left fastener tapes 10 are fixed along the cut-in portion 6*a* of the wet suit 6 by bonding to the rear face with an adhesive agent. Although in this embodiment, a hot melt adhesive agent is used as the adhesive agent, it is permissible to use another adhesive agent if it has affinity with both the fastener tape 10 and the material of the main body of the wet suit 6. Further, it is also permissible to bond them with ultrasonic welding or high frequency welding instead of bonding. If the fastener tape is fixed by sewing in order to secure the waterproof property in this embodiment, water tightness of sewing yarns needs to be maintained.

In this embodiment, as shown in FIGS. 1 and 2, end portions of a single tape shaped connecting member 15 are fixed striding over a tape portion of the right and left fastener stringers 2 at a position apart by about one and half piece of the slider 4 toward the top end stop (not shown) side from the slider 4 in contact with the bottom end stop 3. This connecting member 15 is fixed on the rear face side of the fastener stringer 2, that is, on the lower blade 4*b* side of the slider 4. The connecting member 15 is composed of a flexible material produced by coating the surface of a fiber woven fabric with thermoplastic synthetic resin, and the end portions of the connecting member are fixed to the tape portion of the fastener stringers 2 by ultrasonic welding or high frequency welding. The connecting member 15 of this embodiment is composed of a woven tape of synthetic fiber such as polyester and nylon having a high tensile strength. As for its attachment configuration, as shown in FIGS. 1 and 2, the connecting member 15 is folded into a U-shape, and one side of the folded portion faces a covering tape 16 while right and left end portions are directed to the top end stop (not shown) attached to an end portion opposite to the bottom end stop 3. The identical face sides of the right and left end portions are integrally bonded to each fastener tape 10 of the right and left fastener stringers 2 by ultrasonic welding or with a hot melt adhesive agent.

Further, according to the present invention, the covering tape 16 which is a characteristic portion of the present invention is attached to an area covering at least the bottom end stop 3 and a portion from the bottom end stop 3 up to the connecting member 15. As shown in FIGS. 1 to 4, the covering tape 16 of this embodiment is attached along the entire length of the cut-in portion 6*a* of the wet suit 6. The covering tape 16 is composed of the same material as the wet suit main body. The wet suit 6 is composed of a sheet-like material in which a plastic, stretchable foamed layer such as mild foamed polyurethane or synthetic rubber foamed body is loaded between two thin knitted fabrics having plasticity and high density composed of stretchable fiber yarns on the front and rear sides. The covering tape 16 is attached to the wet suit 6 along one side edge of the cut-in portion 6*a* by sewing or bonding such that the covering tape covers the entire length of the cut-in portion 6*a* of the wet suit 6 from its rear face. In this embodiment, the covering tape 16 is more preferred to be attached by welding with high frequency heating or ultrasonic heating or bonding by welding with heat than by sewing because the article is a wet suit. However, the fixing line is expressed with a sewing line in order to clarify it in the indicated drawings.

According to the present invention, a pressing tape piece 17, which constitutes another characteristic portion of the present invention, is provided between the connecting member 15 and the covering tape 16.

The pressing tape piece 17 is disposed along the longitudinal direction of the covering tape 16 crosswise to the connecting member 15 such that it strides over the connecting member 15 whose both end portions are welded to the rear face of the right and left fastener stringers 2 from the fastener stringer 2 side, and the both end portions thereof are fixed to the rear face of the covering tape by welding. Further, it may be attached by sewing. Although the pressing tape piece 17 may be fixed to the connecting member 15, the pressing tape piece 17 does not always need to be fixed to the connecting member 15 when attempt is made to set the connecting member 15 movable freely between the fixed portions on the both ends of the pressing tape 17. The central portion of the connecting member 15 may be fixed directly to the rear face of the covering tape 16 without using the pressing tape piece 17.

When a user tries to put on or put off the wet suit of this embodiment having the above-described configuration by sliding the slider upward or downward, the cut-in portion 6*a* of the wet suit 6 is opened largely together with the right and left fastener stringers 2. As a consequence, an extremely large force is applied to the wet suit 6 and a so-called tearing force is applied to the slide fastener 1. Unless the connecting member 15 is attached, the force is transmitted directly to the slider, so that a portion of the fastener tape 10 or the fastener element 21 existing on the side of the element diamond 4*c* within an inside passage of the slider 4 makes a firm contact with the slider 4 and is damaged, thereby possibly damaging the slider itself. Further, if the aforementioned strong force which attempts to open the slide fastener 1 is applied, the slider 4, in particular, comes to press the bottom end stop 3 attached to the terminal end on the lower side with a strong force. Consequently, the bottom end stop 3 fixed to the right and left fastener stringers 2 is deformed or its attachment position is deflected, so that it may drop out of the slide fastener 1 depending on circumstances.

According to this embodiment, however, the both end portions of the connecting member 15 are fixed to the right and left fastener stringers 2 at a position above the bottom end stop 3 so as to connect between the stringers 2. For this reason, the aforementioned external strong force is transmitted to the connecting member 15 and received thereby in a straightly stretched state. Consequently, the force is not transmitted to the slider 4 and the fastener tape portion and the fastener element portion existing in the inside passage of the slider 4 to thereby prevent the above-described damage. Moreover, because the aforementioned force is not applied between the fastener stringer 2 and the slider 4, the sliding operation of the slider 4 can be executed smoothly.

In this embodiment, as described above, at least one side edge portion of the covering tape 16 is fixed to the rear face of the wet suit, and the both end portions of the pressing tape piece 17 are fixed to the rear face of the covering tape 16 on the side of the wet suit such that it strides over the front surface side of the connecting member 15 which connects the right and left fastener stringers 2. Consequently, the connecting member 15 is always pressed to the side of the covering tape 16, and when the slider 4 passes through a space between the connecting member 15 and the right/left fastener stringers 2, a sufficient space for the lower blade 4*b* of the slider 4 to pass is secured between the connecting member 15 and the fastener stringer 2, because the connecting member 15 is integrated with the covering tape 16 in a state in which the connecting member 15 is pressed against the covering tape 16. Accordingly, the slider 4 can be slid smoothly without the connecting member 15's being hooked or caught by the slider 4.

Particularly, in this embodiment, the shape of the connecting member 15 is fixed by folding a straight long tape into a U-like shape and setting with heat. For this reason, when a pair of the fastener stringers 2 are opened to the right and left, the U-like shape is changed to a straight shape although the connecting member 15 maintains its U-like shape with the slide fastener 1 closed. Thus, even if a large tearing force is applied to the pair of fastener stringers 2 as shown in FIG. 4, the force is in the same direction as the direction of pulling the connecting member 15. With this configuration, the fixed portions withstand the force uniformly to avoid tearing between the fastener tape 10 and the connecting member 15 due to the tearing force.

Figure 5:
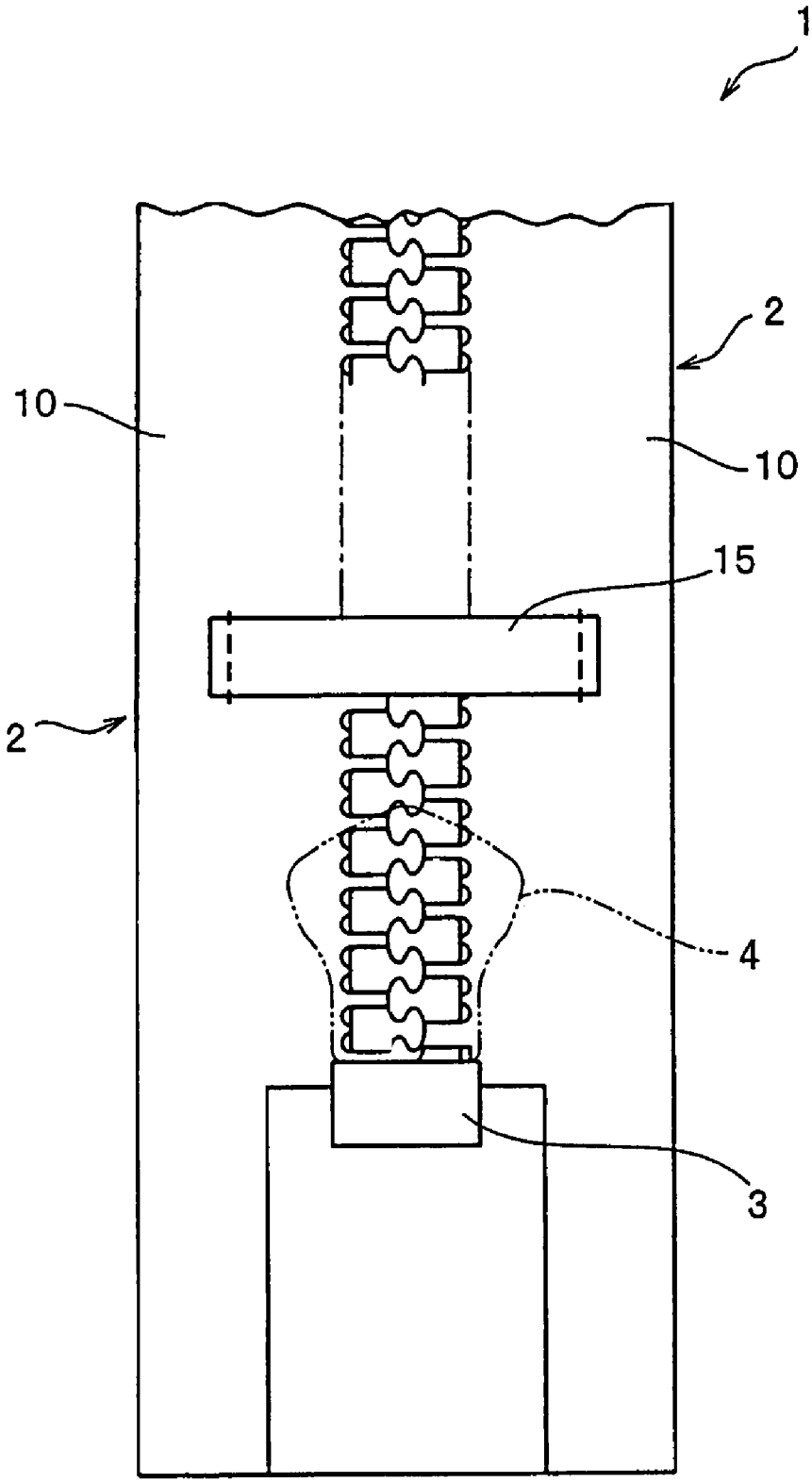
FIG. 5 is a partial rear view according to a modification of the first embodiment.

FIG. 5 shows a modification of the connecting member 15 of the present invention. According to this modification, the connecting member is formed in a mere straight shape without being folded into a U-like shape as described embodiment, and both ends thereof are fixed to the right and left fastener stringers 2 by sewing. Even if the connecting member 15 is fixed to the right and left fastener stringers 2 in its straight condition, a connecting member 15 longer than the connecting member disclosed in U.S. Pat. No. 1,964,485 can be adopted. The reason is due to the existence of the pressing tape piece 17 fixed to the rear face of the covering tape 16 in order to press the connecting member which is a characteristic portion of the present invention against the side of the covering tape. That is, the connecting member 15 is always pressed against the covering tape 16 by the pressing tape piece 17 even if the length of the connecting member 15 set to be larger than the conventional example, so that a space in which the slider 4 passes is always secured to eliminate a possibility of interference between the slider 4 and the connecting member 15.

Second Embodiment

Figure 9:
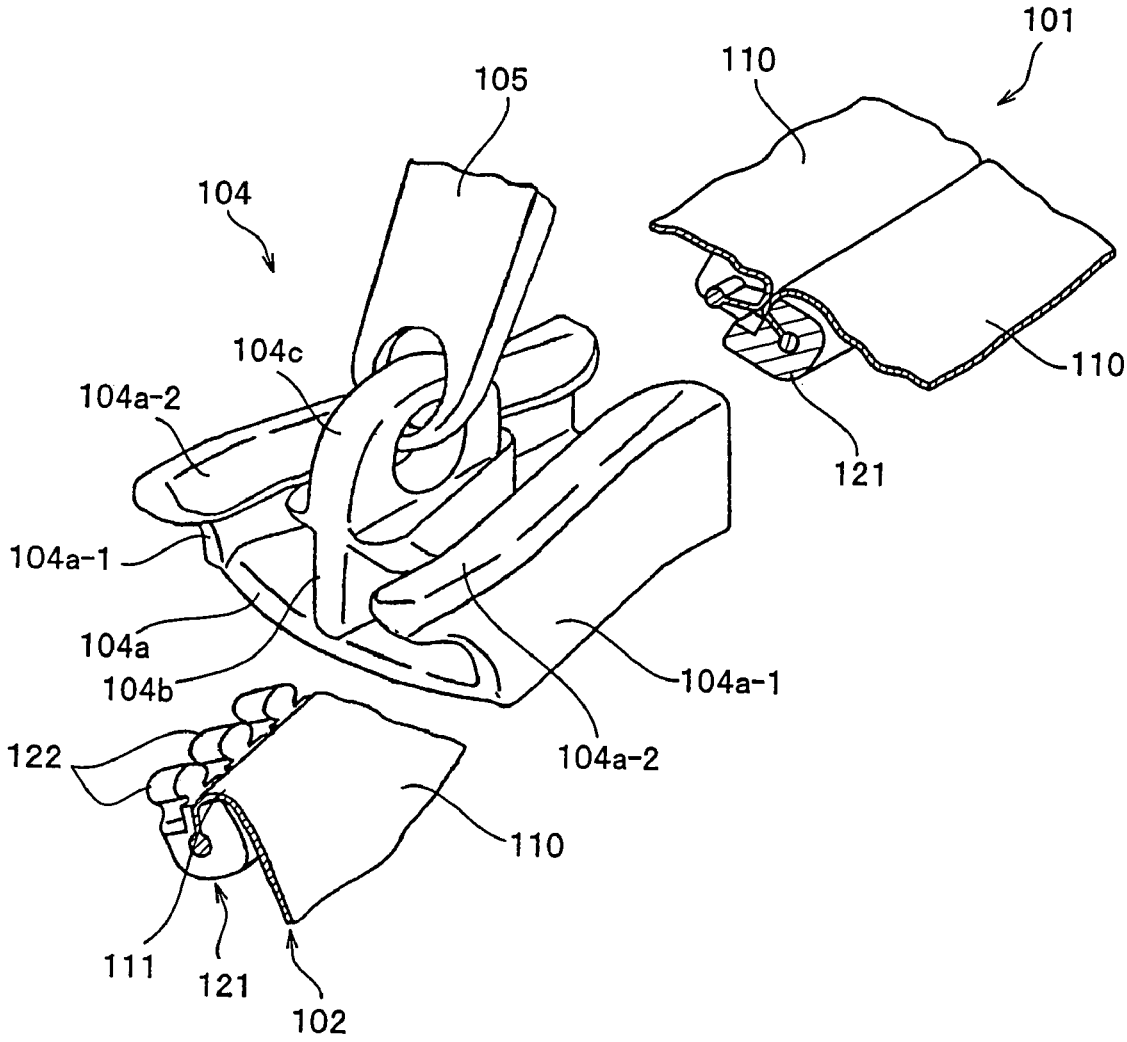
FIG. 9 is a perspective view of a structural example of a concealed type slide fastener which is applied to a second embodiment of the present invention with its part cut out.
Figure 10:
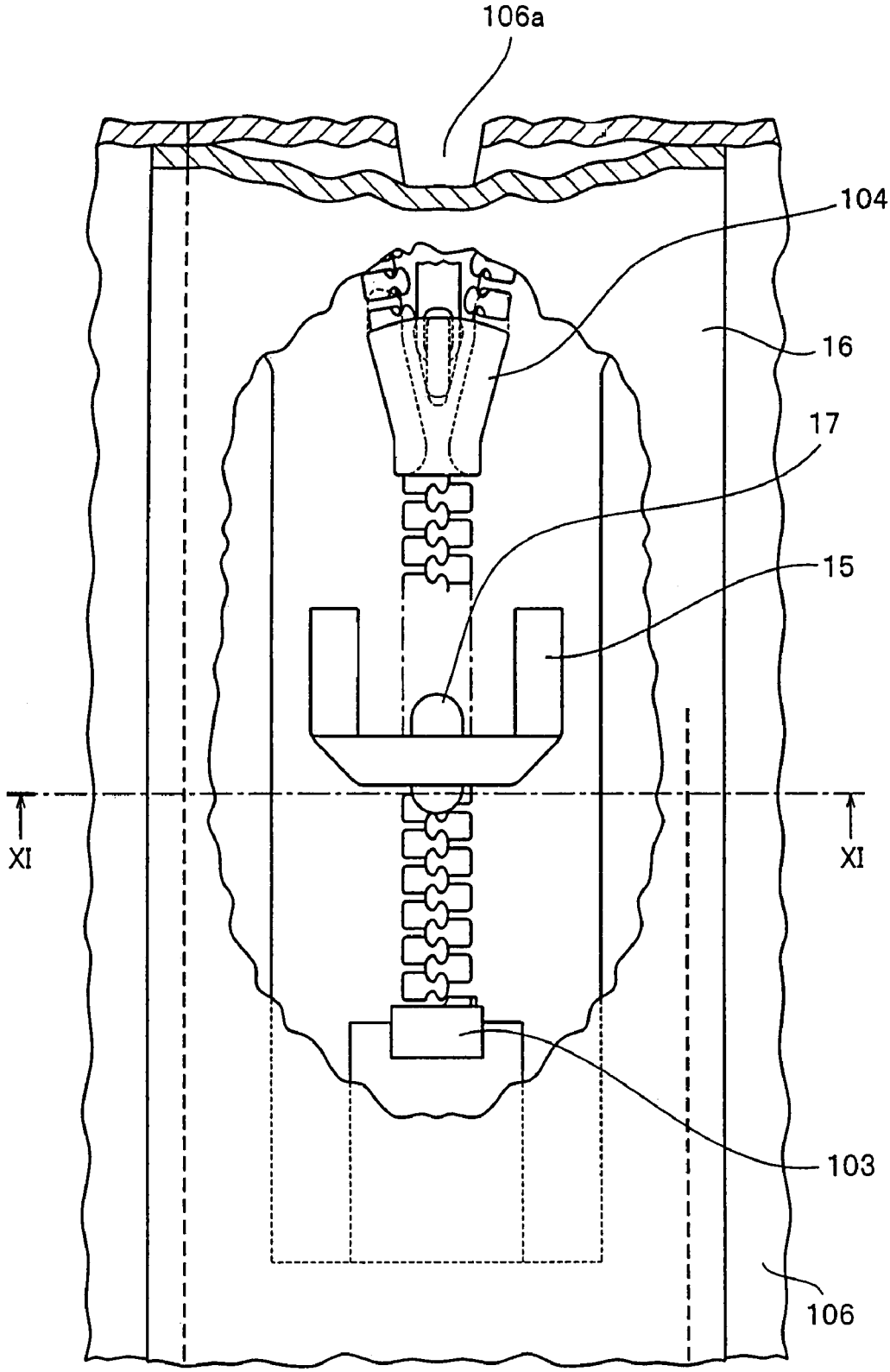
FIG. 10 is a partial rear view of clothes adopting the same slide fastener.
Figure 11:
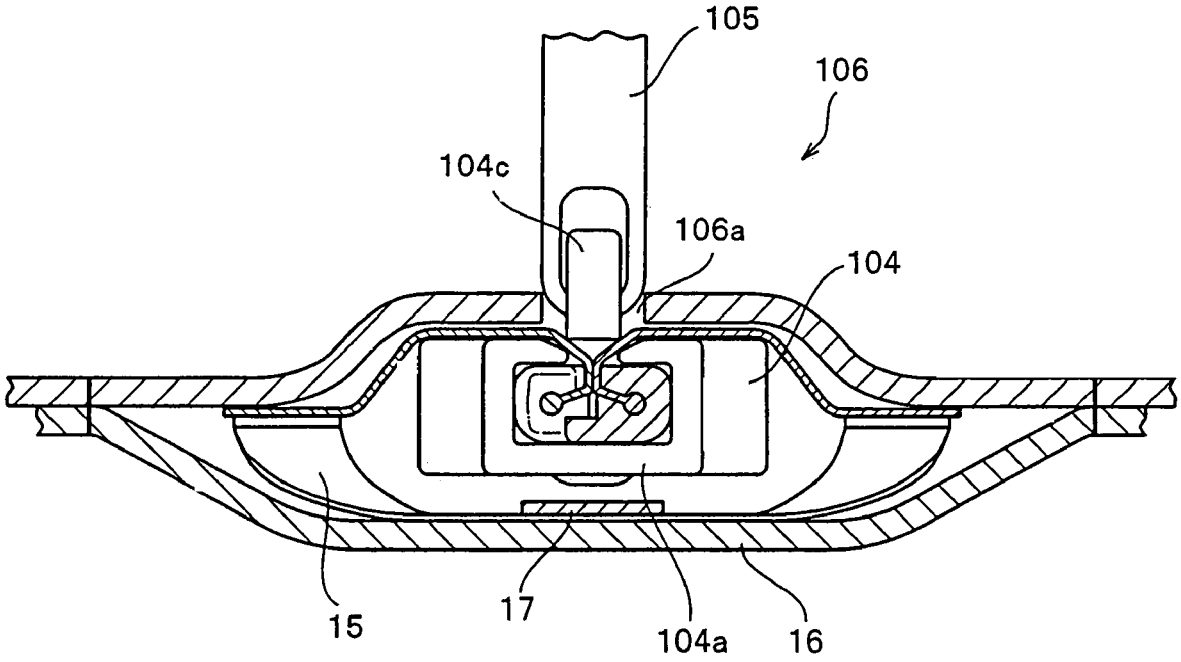
FIG. 11 is a sectional view taken along the line XI-XI in FIG. 10.

FIGS. 9 to 11 show a second embodiment of the present invention. A slide fastener adopted in this embodiment is a slide fastener generally called concealed type slide fastener. The structure of a concealed type slide fastener 101 of this kind will be described just simply because it is well known. In the fastener stringer 102 for the concealed type slide fastener, opposing edge portions of a pair of right and left fastener tapes 110 are bent into a U-like shape in the same direction along its tape surface, and a plurality of fastener elements 121 are attached along the bent ends, as shown in FIG. 9. At this time, coupling heads 122 of the fastener elements 121 project outwardly from the bent ends. On the other hand, the slider 104 for the concealed type slide fastener is different from the slider 4 used in the first embodiment in terms of the structure. As shown in FIG. 9, an element diamond 104*b* is erected in the central portion in the right and left direction on the half portion of the shoulder mouth side of a lower blade 104*a*, and a pull tag supporting ring 104*c* is formed integrally at the front end of the diamond 104*b*.

Right and left flanges 104*a*-1 are erected on right and left ends of the lower blade 104*a*, and eaves portions 104*a*-2 extending to approach each other are formed at the free ends of the respective flanges 104*a*-1, so that a space surrounded by the element diamond 104*b*, the flanges 104*a*-1 and the eaves portions 104*a*-2 constitute an element guide space. In the fastener stringer 102 having the above-described structure, with the bent end portions of the fastener tape 110 and the fastener elements 121 attached to the end portions accommodated in the element guide space, the fastener tape 110 is introduced out through a gap between the element diamond 104*b* and the eaves portions 104*a*-2. When the fastener elements are engaged to close the slide fastener 101, the bent end portions of the right and left fastener tapes 110 make contact with each other, and only the pull tag supporting ring 104*c* and the pull tag 105 of the slider 104 are exposed out while other portions of the slider 104 are concealed on the rear side of the slide fastener 101.

This kind of the concealed type slide fastener is often used for women's clothes such as one-piece dress and skirt. In this kind of the women's clothes, the slide fastener 10 is often attached from its neck portion to the waist portion or from the waist portion to the hip portion. As a result, the slide fastener must be opened or closed by operating the slider 104 in an invisible state. Particularly, the body line changes at a portion from the waist portion to the hip portion, and clothes which the user wears is often produced to trace along the body line. Thus, when the user puts on or puts off such clothes, a strong tearing force is applied to the slide fastener like the above-mentioned wet suit. For this reason, in this embodiment also, the connecting member 15, the covering tape 16 and the pressing tape piece 17 are attached to the rear face of the clothes 106 like the first embodiment. In the meantime, same reference numerals are attached to components substantially coinciding with the components used in the first embodiment.

Also in this embodiment, as shown in FIGS. 10 and 11, one side edge of the covering tape 16 is fixed along the rear face of a cut-in portion 106*a* of the clothes 106 by sewing. Like the above embodiment, the other side edge of the covering tape 16 is fixed to the other side edge of the cut-in portion 106*a* from its bottom end up to near the neighborhood of the attaching portion of the connecting member 15 by sewing. According to this embodiment, the covering tape 106 does not always need to be attached in the entire length of the cut-in portion 106*a* but only needs to be long enough for covering at least from the lower position of the bottom end stop 103 to above the fixing position of the connecting member 15, that is, for covering the members from the bottom end stop 103 to the connecting member 15.

The attachment position of the connecting member 15 is the same as that in the first embodiment, and the attachment position and attachment structure of the pressing tape piece 17 are the same as those in the first embodiment. Therefore, the operating effect achieved thereby is substantially the same as the operating effect of the first embodiment. In the second embodiment, because the object article is women's clothes, a generally plastic and thin fabric material is used and thus, a plastic and high tensile strength material needs to be used for the connecting member 15 and the pressing tape piece 17. To meet such a demand, multi-filament of synthetic fiber, particularly fabric composed of textured multi-filament is preferable, and other materials may be used as required.

Third Embodiment

Figure 12:
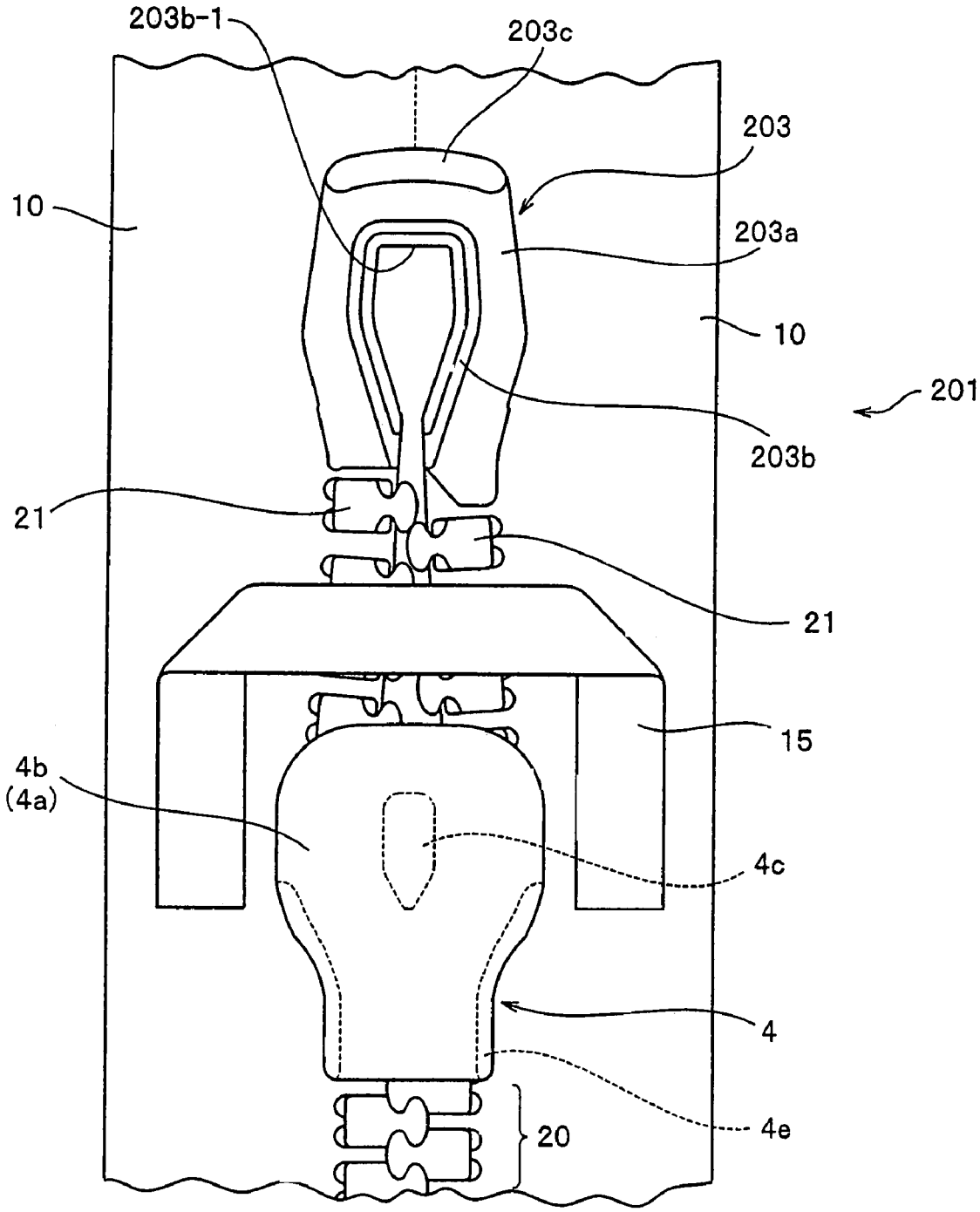
FIG. 12 is a partial rear view showing a structural example of a waterproof slide fastener which is applied to a third embodiment of the present invention.

FIG. 12 is a partial rear view of a waterproof slide fastener applicable to an article of a third embodiment of the present invention. In FIG. 12, only the connecting member 15 which is part of the characteristic portion of the present invention is indicated, and description of the covering tape 16 and the pressing tape piece 17 is omitted. However, the slide fastener 201 has the covering tape and the pressing tape piece like the first and second embodiments. The articles of this embodiment include, for example, a travel bag although not shown, in which two sliders 4 are attached with their rear mouths opposing each other. With reference to FIG. 12, a portion having the same structure is disposed symmetrically below the slide fastener portion indicated in FIG. 12.

The slide fastener 201 of this embodiment is different from the waterproof slide fastener of the first embodiment in terms of a portion of an end stop 203. Thus, same reference numerals are used for substantially the same members or parts as those in the first embodiment.

The end stop 203 of this embodiment is provided striding over the right and left fastener tapes 10 adjacent the right and left fastener elements 21 disposed at upper and lower terminal ends of the element row 20 shown in FIG. 12. Its entire shape is approximate to a planar shape of a horseshoe. More specifically, there exist extending portions which are bent from the U-shaped portion such that they approach each other toward its end portion. However, there is a difference in length corresponding to a single fastener element 21 in the tape direction between positions at the right and left ends thereof. The end stop 203 of this embodiment is formed of an elastic material composed of natural or synthetic rubber or elastomer, and is molded integrally with the waterproof fastener tape 10 by injection molding.

In the FIG. 12, an area thereof striding over the right and left fastener tapes 10 is a reinforcement area 203*a* which has a thickness similar to that from the front face to the rear face of the fastener element 21. Its planar shape is elastically deformable so that it can be fit to a guide passage formed by the upper blade 4*a*, the lower blade 4*b*, the element diamond 4*c* and the flanges 4*e* extending from the right and left edges of the upper and lower blades 4*a*, 4*b* in a direction in which they approach each other, of the slider 4. A projection 203*b* having a height equal to that of the element diamond 4*c* is provided along the inner periphery of the reinforcement area 203*a* such that it projects outwardly from the front and rear surfaces of the fastener tape 10. The outer peripheral side face of the projection 203*b* has a tapered face which spreads to the tape face.

A linearly extending stopper portion 203*c* is provided striding over the right and left fastener tapes 10 on a bottom portion corresponding to the bent portion of the U-shaped plan portion of the reinforcement area 203*a*. The thickness of the stopper portion 203*c* projecting from the front and rear faces of the fastener tape 10 is equal to or larger than the interval of a shoulder mouth formed between the upper and lower blades 4*a*, 4*b* of the slider 4.

Assume that the slide fastener 201 having the above-described configuration is loaded on a bag (not shown) of this embodiment. When the slider 4 of the slide fastener 201 is slid toward the end stop 203, the end stop 203 is guided to the shoulder mouth of the slider 4 by the element diamond 4*c* and introduced into the element guide passage while the right and left end portions of the end stop 203 are expanded. Here, the inside face of a bottom portion 203*b*-1 of the projection 203*b* of the end stop 203 is fit to the shoulder mouth side end face of the diamond 4*c* of the slider 4, and at the same time, the projection 203*b* is fit to the peripheral face of the element diamond of the slider 4 while making a firm contact with the inside faces of the upper and lower blades 4*a*, 4*b*. This prevents rainfall water or the like from invading from outside. Even if a strong external force is applied to an opening portion of the bag and then a strong tearing force is applied to the fastener tape 10, the tearing force is not transmitted directly to the slider 4 because the connecting member 15, the covering tape and pressing tape piece (not shown) are attached. Further, the slider operation is carried out smoothly.

Although the fastener elements of the above embodiment are molded integrally on the fastener tape by injection molding of a synthetic resin, of course, the fastener element of the present invention is not restricted to the above embodiments and may be of a coil-like element made of synthetic resin or metal.

What is claimed is:

1. An article with a slide fastener in which an end stop is attached striding over side edges of a pair of fastener tapes adjacent to an end portion of at least one element row of a pair of right and left fastener stringers each having an element row composed of a plurality of fastener elements provided in line along opposing element attaching edge portions of the pair of fastener tapes, the slide fastener being opened and closed by sliding a slider along the element row, comprising:

a connecting member having flexibility which is disposed at a position adjacent to the end stop, at which no tearing force of the article is transmitted directly to the slider when the slider makes contact with the end stop, and the connecting member connecting rear faces of the right and left fastener stringers; and at least one covering tape which is disposed in an area on a rear face of the article, covering at least the end stop and the connecting member at the same time.

2. The article with the slide fastener according to claim 1, wherein the slide fastener comprises connecting member capturing means for always capturing the connecting member toward a side of the covering tape.

3. The article with the slide fastener according to claim 2, wherein the connecting member capturing means is a pressing tape piece disposed crosswise to the covering tape so as to stride over the connecting member on a side opposite to the covering tape with at least its both ends fixed to a rear face of the covering tape.

4. The article with the slide fastener according to claim 2, wherein the connecting member capturing means comprises fixing means for sewing, welding or bonding a central portion of the connecting member to the covering tape.

5. The article with the slide fastener according to any one of claims 1 and 2, wherein the slider comprises an upper blade, a lower blade, an element diamond disposed between the upper and lower blades, and a pull tag attached to a top face of the upper blade.

6. The article with the slide fastener according to any one of claims 1 and 2, wherein the slider is a slider for a concealed type slide fastener, comprising a lower blade, an element diamond erected from the lower blade, and a pull tag attached to a top end of the element diamond.

7. The article with the slide fastener according to any one of claims 1 and 2, wherein the fastener tape is a waterproof fastener tape in which a waterproof layer composed of elastomer or the like is formed on both front and rear faces of a pair of tape shaped core materials obtained by weaving or knitting.

8. The article with the slide fastener according to any one of claims 1 and 2, wherein the connecting member is folded back into a U-like shape such that both ends of the connecting member are directed in a same direction, and both ends on one face thereof are attached to rear faces of the fastener tapes while a folded-back portion faces a rear face of the covering tape.

9. The article with the slide fastener according to claim 3, wherein the connecting member and the pressing tape piece are fixed to each other at central portions thereof.

10. The article with the slide fastener according to any one of claims 1 and 2, wherein at least one side edge of the covering tape is fixed to the article along an entire length thereof.

* * * * *